US006843089B2

(12) United States Patent
Krajewski et al.

(10) Patent No.: US 6,843,089 B2
(45) Date of Patent: Jan. 18, 2005

(54) METHOD OF PRODUCING SURFACE FEATURES IN SHEET METAL USING SUPERPLASTIC FORMING

(75) Inventors: Paul Edward Krajewski, Sterling Heights, MI (US); George M. Barton, Russelsheim (DE); Gary A. Kruger, Troy, MI (US)

(73) Assignee: General Motors Corporation, Detroit, MI (US)

( * ) Notice: Subject to any disclaimer, the term of this patent is extended or adjusted under 35 U.S.C. 154(b) by 155 days.

(21) Appl. No.: 10/278,600

(22) Filed: Oct. 23, 2002

(65) Prior Publication Data

US 2004/0079129 A1 Apr. 29, 2004

(51) Int. Cl.[7] ..... B21D 26/02; B23P 17/00
(52) U.S. Cl. ..... 72/60; 72/57; 29/421.1
(58) Field of Search ..... 72/56, 51, 58, 72/59, 60, 61, 62, 63; 29/421.1

(56) References Cited

U.S. PATENT DOCUMENTS 2,139,631 A * 12/1938 Dresch et al. ..... 72/60
2,190,659 A * 2/1940 Guerin ..... 72/57
2,368,717 A * 2/1945 Marschner ..... 72/57
3,934,441 A * 1/1976 Hamilton et al. ..... 72/60
4,162,625 A * 7/1979 Simmons ..... 72/57
4,984,348 A * 1/1991 Cadwell ..... 72/60
6,253,588 B1 7/2001 Rashid et al. ..... 72/57
6,550,124 B2 * 4/2003 Krajewski et al. ..... 72/379.2

* cited by examiner

*Primary Examiner*—David Jones
(74) *Attorney, Agent, or Firm*—Kathryn A. Marra

(57) ABSTRACT

The present invention provides a method of embossing or imprinting patterns in the surface of a sheet metal article using superplastic forming at suitable SPF temperatures. A template having a pattern is interposed between a forming tool and a sheet metal blank. Gas pressure is applied to the sheet metal blank. This pressure forces the sheet metal against the surface of the lower forming tool having the template there between. The sheet metal blank is stretch formed according to the contours of the surface of the lower forming press and the template. The embossed and shaped sheet metal part is then removed from the forming tool.

15 Claims, 3 Drawing Sheets

METHOD OF PRODUCING SURFACE FEATURES IN SHEET METAL USING SUPERPLASTIC FORMING

TECHNICAL FIELD

This invention relates to a method of producing sheet metal parts having individualized patterns formed therein, and more specifically to a method of producing a pattern embossed on the surface of a sheet metal panel using a superplastic, or other high temperature, forming process.

BACKGROUND OF THE INVENTION

Superplastic metallic alloys, such as certain fine grain alloys of, for example, aluminum, magnesium, stainless steel and titanium, are relatively ductile and can undergo substantial tensile deformation in the presence of low shaping forces. Such materials are capable of being stretched and formed at suitable forming temperatures over a forming tool or into a die cavity to make complex shaped automotive body parts, or the like. This process is often referred to as superplastic forming.

Durable tools are available for the superplastic forming of aluminum alloy automotive body panels at temperatures of about 500° C. Such tools can often be used to make thousands of parts over the vehicle model period. Having developed the ability to make long production runs of a particular body panel design, designers now are interested in personalized, or individual decorative features, on only a part of the total number of panels produced on the durable, but expensive tool. It is now desirable to have the ability to make specially embossed panels during a production run.

Thus, it is an object of the present invention to provide a method of producing individualized patterns embossed on the surface of sheet metal panels or parts while using a forming tool. It is a more specific object of this invention to produce such personalized patterns on superplastic formable aluminum sheet metal alloys by interposing a suitable template between the sheet blank and the corresponding forming tool surface.

SUMMARY OF THE INVENTION

Superplastic forming processes are known for producing sheet metal panels shaped in conformity with a shaping surface at a superplastic forming temperature. A suitable cold rolled, fine grain aluminum alloy sheet, for example, is heated to 400° C. to 550° C. or so and stretch formed over a forming tool or into a die cavity of a tool held in a suitable press. A complementary forming tool, engaging the periphery of the opposite side of the sheet, confines a high pressure working fluid against the hot sheet to effect the forming operation. The sheet is stretched and/or drawn and shaped in accordance with the shaping surface of the main forming tool. Many sheets can be formed in succession over the tool but they all have the same shape. If one wants, for example, to emboss a special design or emblem on a selected group of the parts, it has been necessary to change the forming tool or to provide a new one.

In accordance with the present invention, a pattern is produced on a portion of the surface of one or more selected sheet metal panels by interposing an embossing or imprinting template between the sheet metal blank and a surface portion of the forming tool. The template provides a forming surface, usually for a relatively small area, at the forming temperature of the sheet metal blank (e.g., about 400° C. to 550° C. in the case of AA5083). The template may be temporarily attached to the tool or it may be suitably bonded to a portion of the sheet metal blank. Typically, the template will be no thicker than the sheet metal itself because the embossment is to provide a visual image and not a structural feature of the panel or other part. The template may be a piece of the same sheet material, or other suitable material that can function as a forming surface at the forming temperature.

The sheet metal blank, after being preheated to its SPF forming temperature, is stretch formed across the shaping surface of the forming tool and the interposed embossing template. Usually the forming of the sheet is accomplished by applying the pressure of a working fluid, such as air, uniformly against the opposite side of the sheet. When the forming of the sheet is completed, including the forming of the individualized embossment, the pressure of the working fluid is released and the hot, formed sheet metal panel is carefully removed from the forming tool for cooling and trimming. If the template was initially attached to the sheet, it is removed as well.

If several sheets are to be embossed with the same image, the template will suitably temporarily be bonded to the forming tool. But if only a single sheet is to receive the embossment, or if successive sheets receive different embossments, it may be preferred to apply the template to the blank. The superplastic material is highly formable at its forming temperature and quite thin, but detailed embossments or imprints can be formed in the sheet material while it is also being shaped for its otherwise intended function. Embossing patterns such as a customer's name, manufacturer's trade model, logo, or the like, are easily formed.

This invention takes advantage of the ability to alter surface conditions and produce accurate and, often, complex designs on the surface of a suitably formable sheet metal panel. Furthermore, the present invention allows the production of these complex designs and the production of an actual body panel using a single-step operation. These and other objects and advantages of this invention will become apparent from the detailed description of the specific embodiment that follows.

DESCRIPTION OF THE PREFERRED EMBODIMENTS

The present invention provides a method of embossing patterns on the surface of a sheet metal panel using a high temperature, superplastic (SPF) forming process. The patterns are individualized embossments or depressions formed using a durable forming tool that does not contain the personalized image.

Figure 1:
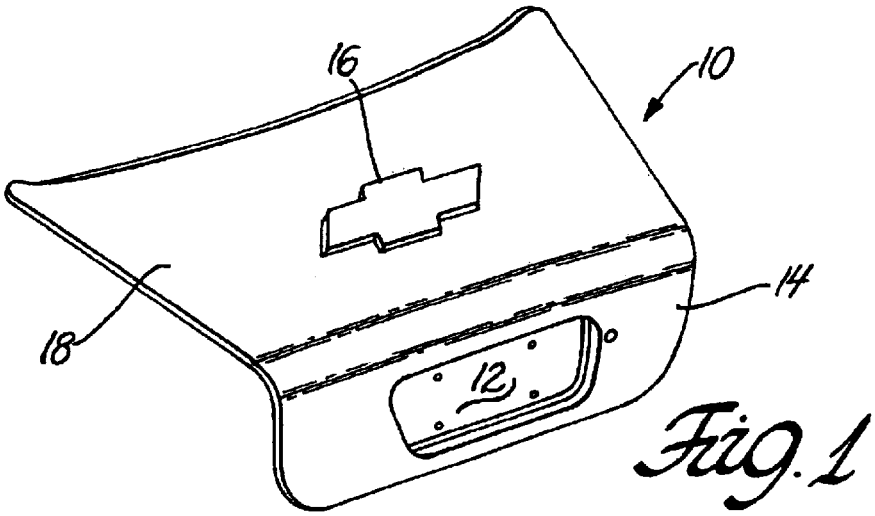
FIG. 1 is an automotive deck lid outer panel formed with an individualized Chevrolet bow tie™ embossment in accordance with the present invention.

The SPF process is particularly useful for forming automotive body parts having complex shapes. In accordance with this invention, the complex shape includes the special image not found on the SPF forming tool. In FIG. 1, deck lid outer panel 10 illustrates a typical automotive body part that is formed by stretch forming of a cold rolled AA5083 sheet metal blank that has been recrystallized with a very fine grain microstructure. Intricate detail, such as the deep license plate pocket 12 on the vertical portion 14 of deck lid 10, is easily formed by taking advantage of the SPF material's excellent formability characteristic. The basic shape of the deck lid panel is formed using a stretch forming tool at about 500° C. An embossment 16 in the image of a Chevrolet bow tie trademark, for example, is formed on the horizontal surface 18 of panel 10 using a template in the forming press.

Generally, the method of superplastic forming comprises stretch forming (with perhaps some drawing) superplastic alloy sheet blanks over a forming tool carried on a forming press after heating the metal blanks to a suitable superplastic forming temperature. A method of such superplastic forming of aluminum alloys, for example, is described in U.S. Pat. No. 6,253,588 to Rashid et al., and is incorporated herein by reference.

Figure 2:
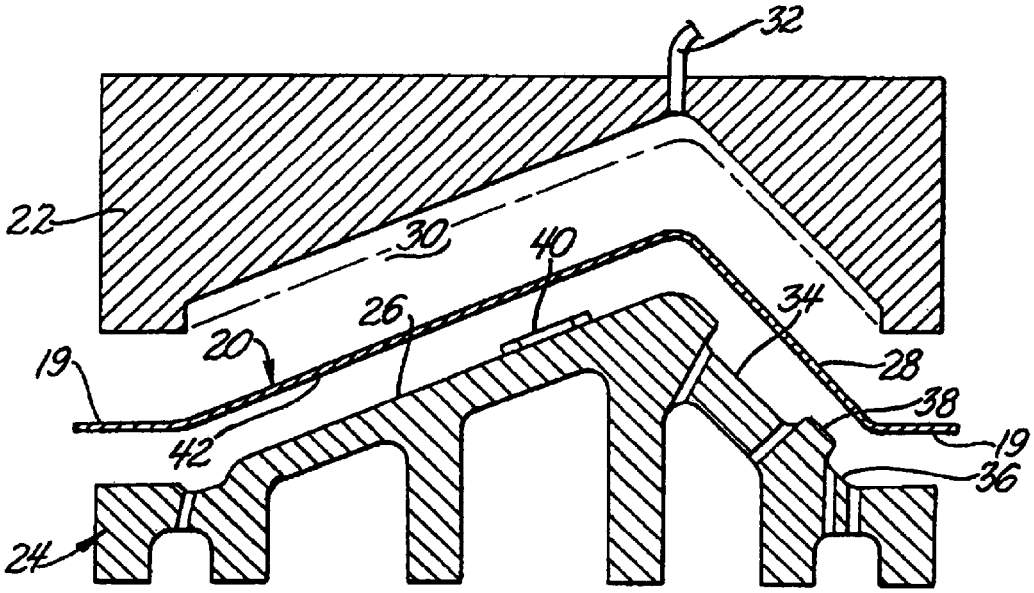
FIG. 2 is a cross-sectional, side view of lower and upper stretch forming tools showing a sheet metal blank interposed between them and an embossing template temporarily adhered to the surface of the lower tool member.

The Rashid et al. patent discusses a method of stretching sheet metal blanks, using differential gas pressure, into conformity with a tool surface in a forming press without encountering excessive thinning or tearing of the sheet. As shown in FIG. 2, a sheet metal blank 20, made of SPF Aluminum Alloy 5083 suitably about one to three millimeters thick, is placed over surface 26 of a lower forming tool 24 inside a forming press (not shown). The sheet is placed in position by means of a material handling device, such as a robot (not shown). Sheet 20 is often pre-bent, as seen FIG. 2, and preheated (e.g., about 400° C. to 550° C.) to a suitable stretch forming temperature. Sheet metal blank 20 is malleable enough to stretch and form according to the contours of shaping surface 26.

An upper forming tool 22 is lowered toward lower tool 24 to sealingly engage the periphery 19 of sheet 20. Sheet 20 is then stretched (or drawn) over forming surface 26 of lower forming tool 24 where surface 26 forms the horizontal surface 18 of deck lid 10 and tool surface 38 forms the vertical surface 14 of panel 10. Tool surface 26 also comprises a plurality of indentations, such as a license plate pocket forming portion 34 and a flange forming portion 36.

Figure 3:
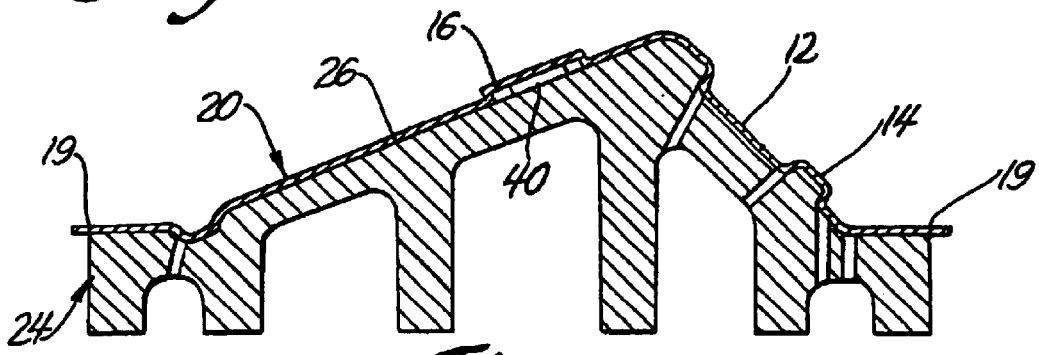
FIG. 3 is a cross-sectional, side view of the lower forming tool of FIG. 2 showing the formed deck lid panel with its embossed feature.

The force for forming panel 10 is provided by the pressure of a working fluid, such as air, nitrogen or argon. The pressurized gas is applied to the back side 28 of heated sheet 20. The gas enters the pressure chamber 30 between upper tool 22 and side 28 of sheet 20 through gas feed line 32. The pressure is progressively increased over a period of seconds or minutes to a suitable level of, for example, 500 psi for aluminum alloy sheets. The hot sheet metal blank 20, which is securely gripped at its edges 19 between tools 22 and 24, then stretches and forms in accordance with the shape of surface 26 of lower forming tool 24. Temporarily located and placed on surface 26 of forming tool 24 is a thin template 40 of a bow tie image. Suitably the template 40 is a thin piece (e.g., 1–2 mm thick) of the AA 5083 alloy sheet. As seen in FIG. 2 the template 40 is carefully placed on the tool surface 26 underlying the portion of blank 20 where the bow tie embossment 16 (as seen in FIG. 3) is to be formed. The template is not a permanent part of tool 24 but is used only in the forming of a predetermined number of panels and then removed from surface 26 of tool 24.

Once sheet 20 is formed, gas pressure is released from chamber 30, tool 22 is raised, and sheet 20 (now panel 10) is removed. The superplasticly formed body panel 10, as shown in FIG. 1, is thus formed having the shape of surface 26 of lower forming tool 24 and the interposed template 40. The image of template 40 is seen as a slightly raised embossment 16, shown in both FIGS. 1 and 3.

Figure 4:
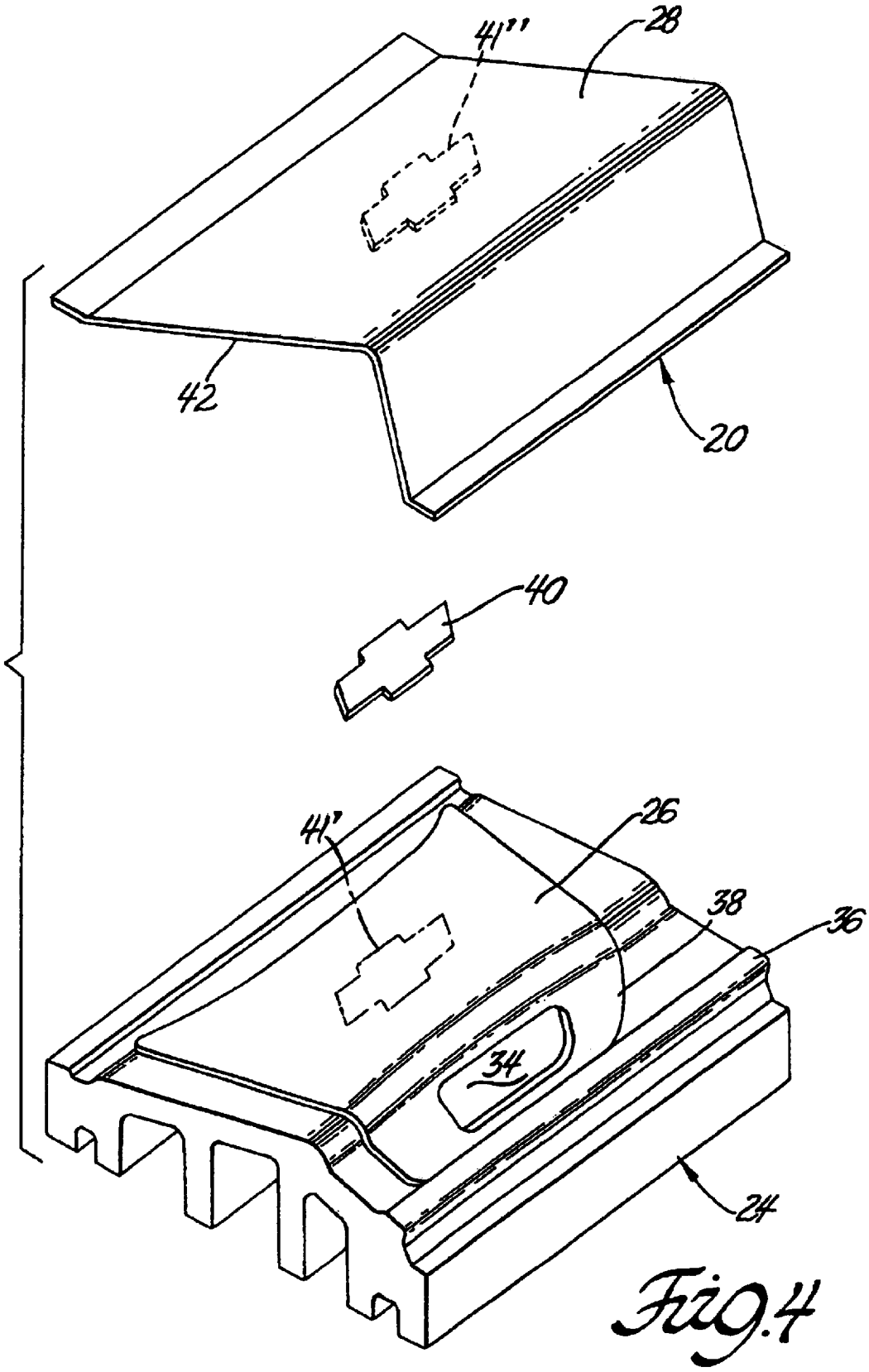
FIG. 4 is an exploded, cross-sectional view of a sheet metal blank and a lower forming tool showing an embossing template in interposed position between the sheet and the forming tool.

An exploded view of the embossment forming setup, i.e., FIG. 4, illustrates that template 40 is spaciously interposed between the sheet metal blank 20 and the forming tool 24 before the forming operation. However, template 40 is, obviously, carefully and precisely located either on the forming surface 26 of the tool 24 or the bottom surface 42, i.e., the tool engaging surface, of the blank 20. In general, it is likely that the template will be temporarily fixed to surface 26 of tool 24, especially if more than one part is to be embossed. However, it is also within the practice of this invention to adhere a template to one or more blanks as they are being prepared for forming. For illustrative purposes, as shown in FIGS. 2 and 3, template 40 is placed and attached on surface 26 of forming tool 24 for the individualized pattern to be formed therein.

As suggested in the SPF process described above, the embossing process requires that the forming press be maintained at a suitable SPF temperature. This temperature differs depending on the type of superplastic material used in the press. As seen in FIGS. 2 and 3, upper forming tool 22 lowers and closes the gap between it and lower tool member 24. After high fluid pressure is exerted on the sheet metal blank through chamber 30, the sheet is forced against the shaping surface 26 of lower tool 24 with template 40 interposed there between. The initial amount of gas pressure applied to the sheet metal blank will change in accordance with the thickness and size of the sheet. During a time interval of anywhere between a several second to a several minute cycle of increasing pressure application up to about 500 psi, the sheet conforms itself to the shaping surface 26 of lower tool 24 and embossing template 40.

Sheet metal blank 20 suitably comprises a superplastic material, such as suitable aluminum, titanium, magnesium or stainless steel alloys. The size and thickness of sheet metal blank 20 can vary depending upon the kind of automotive body part desired and the complexity of the pattern 16 to be embossed thereon.

In a typical SPF stretch forming process for aluminum alloys, the sheet metal blank is suitably sprayed with boron nitride, a high temperature lubricant. A thin uniform film of boron nitride, or the like, is applied to the side of the blank that is contacted by the forming tool. The lubricant is often needed because the sheet is stretched and pulled in frictional contact against the forming surface. The lubricant reduces scratches or blemishes in the sheet during forming. The lubricant film is of uniform thickness and, preferably, does not affect the surface of the formed part. But selective application and thickness control of the lubricant film can allow the film to serve as a template in this process as will be described below.

Figure 5:
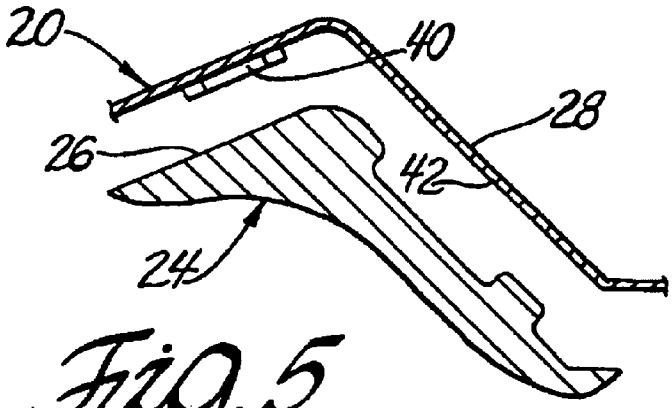
FIG. 5 is a fragmentary cross-sectional, side view of the lower forming tool showing an embossing template adhered to the surface of the sheet metal blank prior to forming of the blank.

When an embossing template 40 is employed on a job, it is interposed between the sheet metal blank 20 and lower forming tool 22, as shown in FIG. 4. The image 16 of template 40 is reflectively shown in FIG. 4 as image 41' on tool 24 and as 41" on sheet 20. Suitably, template 40 is secured, temporarily, to either the back side of sheet metal blank 20 (as seen in FIG. 5) or to forming surface 26 of lower forming tool 22 (as seen in FIGS. 2 and 3). When the forming process is complete, template 40 will be removed and optionally kept for subsequent use.

Template 40 can be secured to the desired attaching surface by mechanical means, such as tack welding it to the forming surface 26 or to sheet metal blank 20. The tack weld is such that template 40 can easily be removed. Template 40 can also be placed into a step (not shown) formed into tool surface 26, which then holds template 40 in place as upper forming tool 24 closes. Such a relieved portion in the forming tool is closed with a removable plate during normal forming operations. Alternatively, template 40 can be adhesivly bonded to forming surface 26 or to sheet metal blank 20.

If template 40 is chemically adhered to either the forming surface 26 of lower tool 24 or to sheet metal blank 20, it is desired to use an adhesive that allows easy removal of template 40 from its attached surface. Furthermore, the adhesive should be removable from template 40 so that template 40 can be reused in the stretch forming process. Using water glass as an adhesive is highly desirable because it is stable and non-reactive at elevated temperatures, unlike most other adhesives. This adhesive is an aqueous solution or suspension of sodium silicate. It is prepared by dissolving silica in a relatively strong sodium hydroxide solution. When the viscous solution is dried, a glassy residue is formed, which is, thus, used as the adhesive. The water glass solution readily bonds two metallic pieces together at room temperature and maintains the bond during heating of the surfaces to a suitable SPF temperature. At the conclusion of the forming operation and after cooling the press, water may be used to separate the metallic pieces and to remove the water glass adhesive.

Similar to that of the sheet metal blank, template 40 is suitably made of a superplastic material, such as aluminum, titanium, stainless steel, or magnesium. SPF sheet materials are readily shaped by the thin embossing templates. Although the template is capable of being stretch formed along with the sheet metal blank, deformation of the template is unlikely based on the manner in which it is used. The template is, however, strong and durable to ensure that the template has a long operable life and is reusable.

The template can be made by laser cutting, casting, manual trimming, or the like and its thickness can vary relative to the thickness of the sheet metal blank. It can be fashioned as a name, logo, picture, or virtually any desired image for attractive vessel effect. Typically, the template is no thicker than the sheet metal blank. For example, the template can be produced by casting and machining a piece of 390 aluminum. The template is sprayed with boron nitride, or another high temperature lubricant, and adhered to either the surface of the sheet metal blank or the forming surface of the lower forming tool. For aluminum alloy materials, a pattern can be formed on the sheet metal blank at a forming temperature of about 500° C. using, e.g., a 6 minute forming cycle.

Another example of an embossing template is a paper template where a pattern is cut out of it. The template is dipped in water and placed on the surface of the blank. The water creates surface tension between the paper and the blank, allowing it to securely hold. The aluminum blank is sprayed with a lubricant and heated to a suitable SPF temperature. After carefully removing the paper template, a region void of lubrication in the shape of the template will remain.

As an alternative to placing template 40 on surface 26 of forming tool 24, FIG. 5 shows that template 40 can be placed on surface 42 of sheet metal blank 20 to produce embossment 16. In applications, for example, in which a relatively few sheets are to be given the special embossment; it may be preferred to apply the template to the sheet metal blank. Similarly, in applications where successive sheets are given different embossments, it may be preferred to apply the different templates on the successive sheets as they are prepared for forming. As disclosed above, the sheet metal blanks are usually washed, dried, lubricated with boron nitride or the like, pre-bent for location on the forming tool and preheated to the specified forming temperature before they are mechanically placed on the forming tool 24. If many sheets are to receive individualized embossments, suitable templates might most efficiently be placed on the sheets rather than on the forming tool during such sheet preparation.

Figure 6:
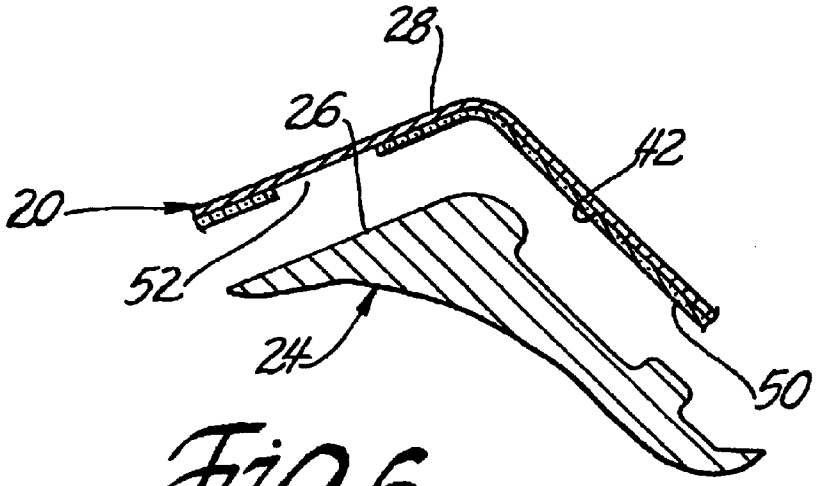
FIG. 6 is a fragmentary cross-sectional, side view of the lower forming tool showing the bottom surface of the sheet metal blank coated with a film of lubricant except for a missing portion defining a bow tie configuration to be formed as a depressed image in the sheet metal surface.
Figure 7:
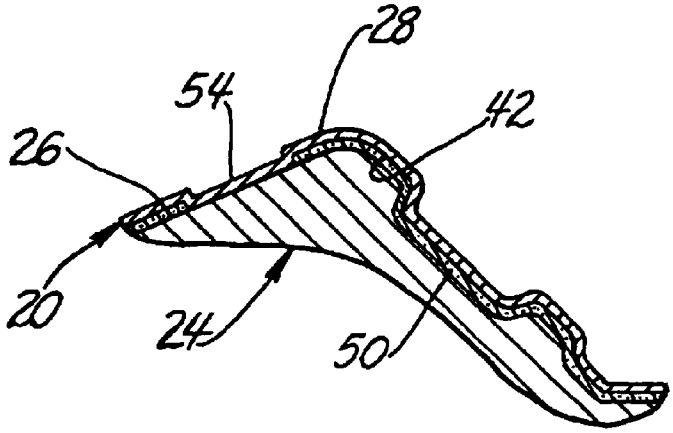
FIG. 7 is a cross-sectional, side view of the lower forming tool of FIG. 6 showing the formed deck lid panel where the embossed feature is depressed against the tool in a missing portion of lubricant on the sheet metal.

FIGS. 6 and 7 illustrate a different embodiment of practicing the invention. Apart from unitary bodies like sheet metal or paper being used as embossing templates, the embossing surface can be a build up of a layer of particulate material such as a sprayed layer of boron nitride lubricant.

In FIG. 6, a relatively thick layer 50 (1 to 2 millimeters) of Lubricant has been formed over the entire surface 42 of sheet metal blank 20, except for region 52, which is shaped like a bow tie. Bow tie shaped region 52 is suitably masked during the application of lubricant layer 50. If masking of the sheet metal surface is not preferred, region 52 can be removed from an initially full surface lubricant layer 50. Thus, FIG. 6 illustrates the use of a particulate template material and the practice of a "negative" template rather than the "positive" template 40, as used in the examples of FIGS. 2, 3 and 5.

Differential gas pressure is then applied to upper surface 28 of sheet 20 in the arrangement of FIG. 6 and sheet 20 is stretch formed over surface 26 of lower forming tool 24 with template layer 50, including relieved region 52, between them. As seen in FIG. 7, material from sheet metal blank 20 is stretched into negative template region 52 to form an embossment 54 that is depressed with respect to the local surrounding sheet metal of panel 10. In this embodiment, embossment 54 is of bow tie configuration but is depressed rather than raised in the panel surface, like embossment 16 in FIGS. 1 and 3.

While the invention has been described using the aforementioned preferred embodiments, it is not intended to be limited to the above description, but rather only to the extent of the following claims.

What is claimed is:

1. A process for making sheet metal panels of a desired first configuration by successively stretch forming sheet metal blanks, at a forming temperature for said blanks, under fluid pressure against a durable forming tool and forming an additional feature on said sheet, the process for said feature of said configuration on one or more selected panels comprising:

providing a template for said feature, said template having a thickness no greater than the thickness of said sheet and being capable of imprinting a selected portion of a said panel;

placing said template between said selected portion of said sheet metal blank and, said forming tool;

stretch forming said sheet metal blank at said forming temperature against said forming tool and said placed template to form said panel having said configuration including said feature; and removing said sheet metal panel from said tool.

2. A process as recited in claim 1 comprising stretch forming said sheet metal blank at said forming temperature against said forming tool and said template to form said panel having said configuration including said feature, said template raising the surface of said blank in a direction away from said tool to form said feature.

3. A process as recited in claim 1 comprising stretch forming said sheet metal blank at said forming temperature against said forming tool and said template to form said panel having said configuration including said feature, said template permitting the surface of said blank to be depressed in the direction of said tool to form said feature.

4. A process as recited in claim 1 said comprising providing a sheet metal blank that has a thickness up to about three millimeters and a template that is no thicker than said blank.

5. A process as recited in claim 4, comprising attaching said sheet metal template to the surface of said sheet metal blank, or to the surface of said forming tool, using an adhesive material.

6. A process as recited in claim 5, further comprising attaching said template to the surface of said sheet metal blank or to the surface of said forming tool using an adhesive comprising sodium hydroxide, silicon dioxide, and water.

7. A process as recited in claim 1, comprising mechanically attaching said template to the surface of said sheet metal blank, or to the surface of said forming tool.

8. A process as recited in claim 1 comprising providing a sheet metal blank is of a superplastic formable aluminum alloy.

9. A process as recited in claim 1 comprising providing a template by spraying a comprising solid lubricant.

10. A process as recited in claim 1 comprising providing a template that comprises paper.

11. A process as recited in claim 1 comprising stretch forming said sheet metal blank at said forming temperature against said forming tool and said placed template to form said panel having said configuration including said feature, said feature comprising a word, name, symbol, picture, or combination thereof.

12. A process for making sheet metal panels of a desired first configuration by successively stretch forming sheet metal blanks, at a forming temperature for said blanks, under fluid pressure against a durable forming tool and forming an additional feature on said sheet, the process for said feature of said configuration on one or more selected panels comprising:

providing a template for said feature, said template having a thickness no greater than the thickness of said sheet and being capable of imprinting a selected portion of a said panel;

placing said template on said forming tool;

stretch forming said sheet metal blank at said forming temperature against said forming tool and said template to form said panel having said configuration including said feature;

removing said sheet metal panel from said tool; and removing said template from said tool after said one or more panels have been formed with said feature.

13. A method as recited in claim 12 comprising attaching said sheet metal template to said forming tool using an adhesive material.

14. A method as recited in claim 12 comprising attaching said template to said sheet metal blank using an adhesive material.

15. A process for making sheet metal panels of a desired first configuration by successively stretch forming sheet metal blanks, at a forming temperature for said blanks, under fluid pressure against a durable forming tool and forming an additional feature on said sheet, the process for said feature of said configuration on one or more selected panels comprising:

providing a template for said feature, said template having a thickness no greater than the thickness of said sheet and being capable of imprinting a selected portion of a said panel;

placing said template on said selected portion of said sheet metal blank;

stretch forming said sheet metal blank at said forming temperature against said forming tool and against said placed template to form said panel having said configuration including said feature; and removing said sheet metal panel and said template from said tool.

* * * * *